US005137456A

United States Patent [19]

Desai et al.

[11] Patent Number: 5,137,456

[45] Date of Patent: Aug. 11, 1992

[54] HIGH DENSITY, SEPARABLE CONNECTOR AND CONTACT FOR USE THEREIN

[75] Inventors: Kishor V. Desai, Vestal; Thomas G. Macek; Maganlal S. Patel, both of Endicott; Edwin L. Thomas, Apalachin, all of N.Y.

[73] Assignee: International Business Machines Corporation, Armonk, N.Y.

[21] Appl. No.: 787,285

[22] Filed: Nov. 4, 1991

[51] Int. Cl.[5] ..... H01R 9/09

[52] U.S. Cl. ..... 439/66; 439/65; 439/74; 439/81; 439/591

[58] Field of Search ..... 439/65, 66, 74, 80, 439/81, 591

[56] References Cited

U.S. PATENT DOCUMENTS

| | | | |
|---|---|---|---|
| 2,956,141 | 10/1960 | Smith | 200/166 |
| 3,173,732 | 3/1965 | James | 339/17 |
| 3,715,706 | 2/1973 | Michel et al. | 439/65 |
| 3,858,154 | 12/1974 | William | 339/17 LM |
| 3,960,424 | 6/1976 | Weisenburger | 339/17 M |
| 4,027,935 | 6/1977 | Byrnes | 339/17 M |
| 4,161,346 | 7/1979 | Cherian et al. | 339/17 M |
| 4,295,700 | 10/1981 | Sado | 339/17 M |
| 4,655,519 | 4/1987 | Evans et al. | 339/17 CF |
| 4,664,458 | 5/1987 | Worth | 339/17 M |
| 4,688,864 | 8/1987 | Sorel | 439/74 |
| 4,941,830 | 7/1990 | Tkazyik et al. | 439/59 |
| 4,969,826 | 11/1990 | Grabbe | 439/66 |
| 4,971,565 | 11/1990 | Fox, Jr. | 439/74 |
| 5,049,084 | 9/1991 | Bakke | 439/591 |

OTHER PUBLICATIONS

IBM Technical Disclosure Bulletin vol. 34, No. 7B, Dec. 1991, Fine Pitch Parallel Board Connector, pp. 154–156; 439/66.

IBM Technical Disclosure Bulletin vol. 6, No. 10, Mar. 1964, pp. 5–6, "Plated Through-Hole Contact", by H. C. Schick.

*Primary Examiner*—Paula A. Bradley

*Attorney, Agent, or Firm*—Lawrence R. Fraley

[57] ABSTRACT

An electrical connector for interconnecting a pair of circuit members (e.g., printed circuit boards) wherein the connector includes a plurality of electrical contacts, these contacts including at least one semi-spherical end portion for engaging a respective conductor on one of the circuit members. Significantly, the semi-spherical end portion is capable of moving in two different directions of rotation during such engagement to provide an effective wiping motion against the surfaces of the member's conductor. In one embodiment, the connector includes contacts with opposed, semi-spherical end portions, while in another embodiment, a singular semi-spherical end portion is taught.

15 Claims, 4 Drawing Sheets

HIGH DENSITY, SEPARABLE CONNECTOR AND CONTACT FOR USE THEREIN

TECHNICAL FIELD

The invention relates to the field of electrical connectors and particularly to electrical connectors for interconnecting at least two electrical circuit members such as printed circuit boards, circuit modules or the like. Even more particularly, the invention relates to connectors of this type which may be used in the information handling system (computer) environment.

CROSS-REFERENCE TO CO-PENDING APPLICATION

In Ser. No. 07/628,057, entitled "High Density Connector" (F. W. Chapin et al), filed Dec. 17, 1990, there is defined a high density connector which utilizes a plurality of elongated, curved spring contact members as part thereof. End segments of each contact provide engagement with circuit conductors (e.g., flat conductive pads) on opposed circuit members. Ser. No. 07/628,057 is assigned to the same assignee as the present invention.

In Ser. No. 07/734,419, entitled "High Density Connector" (F. W. Chapin et al), filed Jul. 23, 1991, there is claimed a high density connector which includes a plurality of resilient contacts (each comprised of insulative material having conductive particles therein) for interconnecting opposed circuit members, the contacts located within a common carrier. Ser. No. 07/734,419 is also assigned to the same assignee as the present invention.

BACKGROUND OF THE INVENTION

The present trend in connector design for those connectors utilized in the computer field is to provide both high density and highly reliable connections between various circuit members which form important parts of the computer. High reliability for such connections is essential due to potential end product failure, should vital misconnections of these devices occur. Further, to assure effective repair, upgrade, and/or replacement of various components of the system (i.e., connectors, cards, chips, boards, modules, etc.), it is also considered important that such connections be separable and reconnectable in the field within the final product, as well as tolerant of dust and fibrous debris. Separability is also particularly desirable during manufacturing of such products, e.g., to facilitate testing.

One known method for providing various interconnections is referred to as a wire bond technique, which involves the mechanical and thermal compression of a soft metal wire, e.g., gold, from one circuit to another. Such bonding, however, does not lend itself readily to high density connections because of possible wire breakage and accompanying mechanical difficulty in wire handling. Another technique involves strategic placement of solder balls or the like between respective circuit elements, e.g., pads, and reflowing the solder to effect interconnection. While this technique has proven extremely successful in providing high density interconnections for various structures, this technique does not allow facile separation and subsequent reconnection. In yet another technique, an elastomer has been used which included therein a plurality of conductive paths, e.g., small diameter wires or columns of conductive material, to provide the necessary interconnections.

Known techniques using such elastomeric materials typically possess the following deficiencies: (1) high forces are usually required per contact; (2) relatively high electrical resistance through the interconnection between the associated circuit elements, e.g., pads; (3) sensitivity to dust, debris and other environmental elements which could adversely affect a sound connection; and (4) limited density, e.g., due to physical limitations of particular connector designs. Such prior art elastomeric structures also typically fail to provide effective wiping connection, which form of connection is especially desired in many high density interconnection schemes.

Attention is directed to U.S. Pat. Nos. 3,173,732, 3,960,424, 4,161,346, 4,655,519, 4,295,700, 4,664,458, 4,688,864 and 4,971,565 for various techniques for providing electrical interconnections for a variety of electrical circuit members. As understood from a reading of these patents, the techniques described therein include many of the aforedefined disadvantages, e.g., potential misalignment, low density, etc. as well as others, e.g., relatively complex design, costly to manufacture, etc.

It is believed that a high density electrical connector capable of providing effective, reliable connections (including providing a rotational, wiping type of connection), wherein such connections are repeatable (such that connection and reconnection can readily occur), and which provides the other advantageous features discernible from the following description would constitute a significant advancement in the art.

DISCLOSURE OF THE INVENTION

It is, therefore, a primary object of the present invention to enhance the electrical connector art.

It is yet another object of the invention to provide an electrical connector capable of providing high density interconnections of a highly reliable and improved nature, which connections can be readily separated and repeated, if desired.

It is yet another object of the invention to provide such a connector which is relatively inexpensive to manufacture and also of relatively simple design.

In accordance with one aspect of the invention, there is provided a connector for electrically interconnecting a pair of electrical circuit members, the connector comprising an electrically insulative member for being positioned between the circuit members, and at least one electrically conductive, resilient contact positioned within the member and including at least one curved end portion for engaging one of the circuit members. Significantly, this curved end portion is movable in a first direction of rotation during initial engagement with the circuit member and thereafter movable in a second, different direction of rotation during subsequent circuit member engagement.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
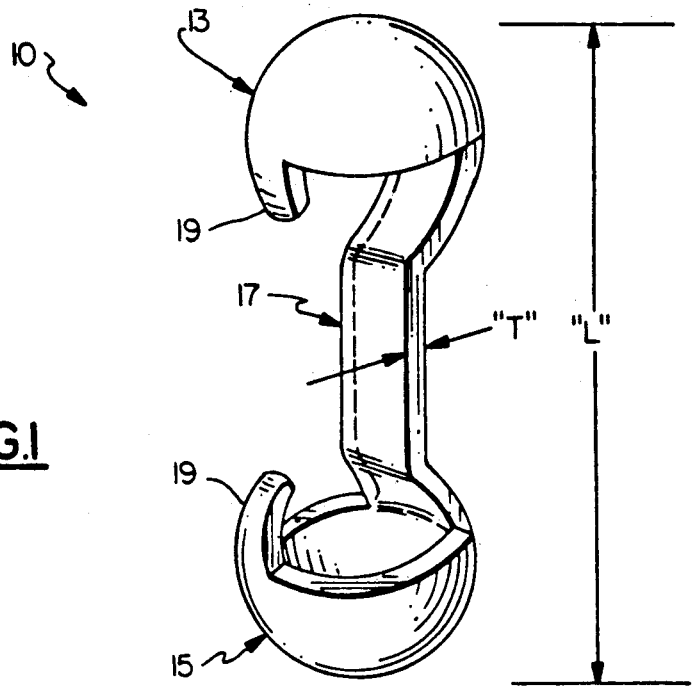
FIG. 1 is an enlarged perspective view of a contact for use in a preferred embodiment of the invention.

In FIG. 1, there is shown an electrical contact 10 for use within an electrical connector 11 (FIG. 2) in accordance with a preferred embodiment of the invention. Connector 11, as defined herein, is specifically designed for electrically interconnecting first and second electrical circuit members to provide high density interconnections between such circuit members, as is strongly desired in the computer industry. Examples of suitable circuit members for being interconnected by the present invention including printed circuit boards, circuit modules, etc. By the term printed circuit board as used herein is meant to include a multi-layered circuit structure including therein one or more conductive (e.g., signal, power and/or ground) layers. Such printed circuit boards, also occasionally referred to in the art as printed wiring boards, are well known in the art and further description is not believed necessary. By the term circuit module as used herein is meant to include a substrate or the like member having various electrical components (e.g., semiconductor chips, conductive circuitry, conductive pins, etc.) which may form a part thereof. Examples of such modules are mentioned in U.S. Pat. Nos. 4,688,151 and 4,912,772, and also illustrated in FIG. 7 (described below). Further description of such modules is thus not believed necessary.

Connector 11, as stated, is specifically designed for providing high density connections between such circuit members. To accomplish this, connector 11 preferably includes a plurality of contacts 10 therein, each contact being designed to provide a singular connection path between respective circuitry on the two circuit members being electrically joined. By the term high density as used herein is thus meant to define an arrangement of several individual such contacts within the invention as being located in a closely positioned array. In one example of the invention, it is preferred that contacts 10 be positioned in a substantially rectangular pattern (e.g., FIG. 2) and spaced from the nearest, adjacent such contact at a minimum distance of only about 0.050 inch. This spacing is not meant to limit the invention, however, nor is the invention directed solely to rectangular arrays, in that other spacings and arrays are readily possible. Further description of this arrangement is also provided below with respect to the embodiment of FIG. 7.

It is understood that the contacts and connector depicted in the drawings are shown on a substantially enlarged scale, for illustration purposes. It is understood that these components are much smaller than depicted. In one example of the invention, each contact possesses an overall length (dimension "L" in FIG. 1) of only about 0.120 inch.

Contact 10, as shown in FIG. 1, is preferably of a known metallic material used in contact members, including, e.g., phosphor bronze, copper, beryllium-copper, etc. Additionally, the contacting end portions thereof (defined below) are also each preferably plated with a corrosion-resistant, sound conducting material such as gold, nickel, palladium, etc. In a preferred embodiment of the invention, each of the contacting portions is plated with a flash (thin layer) of gold. In one example, about fifty microinches of gold was applied for this purpose. Each contact member as used herein is preferably formed from a strip member of the desired metallic material and formed to the desired shape further described herein. In original form, this strip may possess a thickness of only about 0.004 inch to about 0.005 inch, with the resulting contacts 10 formed therefrom having a thickness (dimension "T" in FIG. 1) slightly less than this original thickness, such reduction the result of the various operations to which the strip is subjected.

In the embodiment of the invention as depicted in FIGS. 1-5, contact 10 includes a pair of opposed curved end portions 13 and 15, interconnected by an intermediate portion 17. Each curved end portion is designed for mating with and contacting a respective conductor or the like which forms part of the aforementioned circuit member. Examples of such conductors, as defined herein, include plated through holes as are typically found in many multi-layered printed circuit boards. It is understood, however, that the invention is not specifically limited to connecting such conductors as it is also readily possible to use the teachings of the instant invention to provide interconnections between other types of conductors on circuit members, including relatively flat conductive pads (e.g., copper) or the like, such as described below with respect to the embodiment shown in FIG. 7.

Each curved end contacting portion 13 and 15 is formed during the aforementioned formation of contact 10 from the original strip, and, more preferably, is of a substantially semi-spherical configuration. This is considered an important aspect of the invention in order to provide the dual rotational movement defined hereinbelow. Each contacting end portion further preferably includes a projecting tab 19 which projects from the semi-spherical portion at a location substantially opposite the jointure between the intermediate portion 17 and the semi-spherical portion. These projecting tabs are thus arranged in a substantially facing arrangement relative to each other, as illustrated in FIG. 1.

Figure 2:
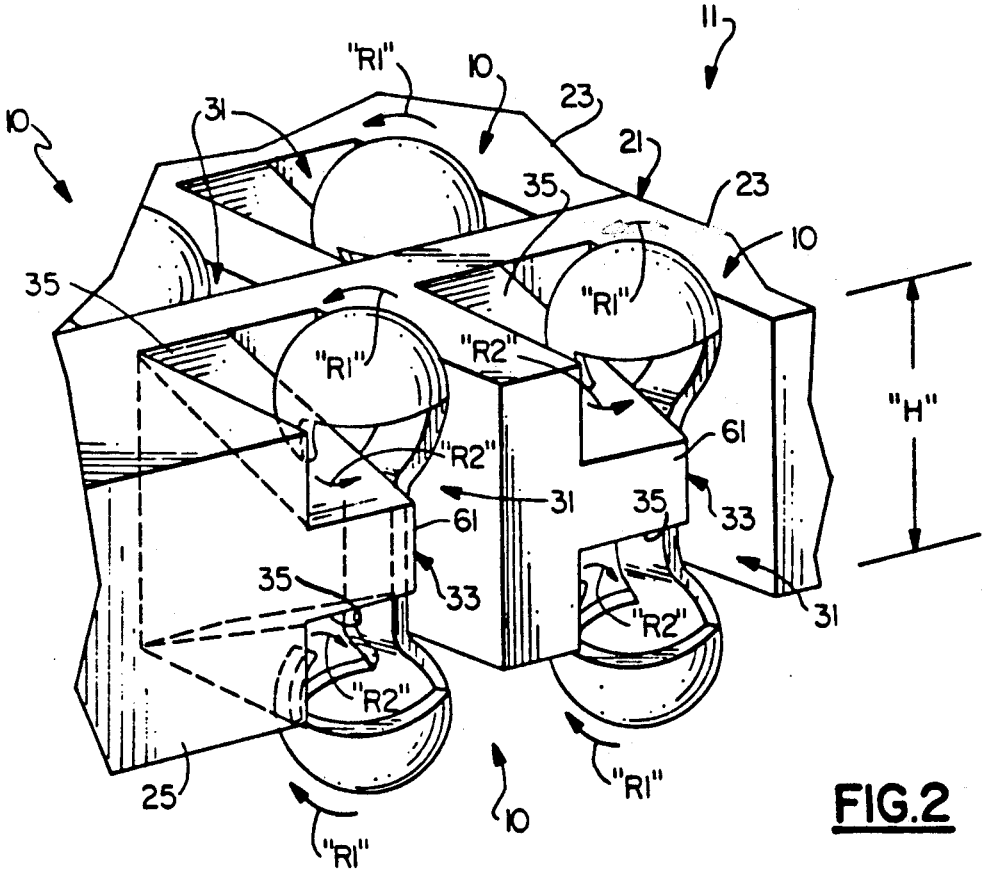
FIG. 2 is a partial perspective view, on a slightly reduced scale over the view in FIG. 1, illustrating the contact depicted in FIG. 1, along with other similar contacts, located within an insulative member.
Figure 4:
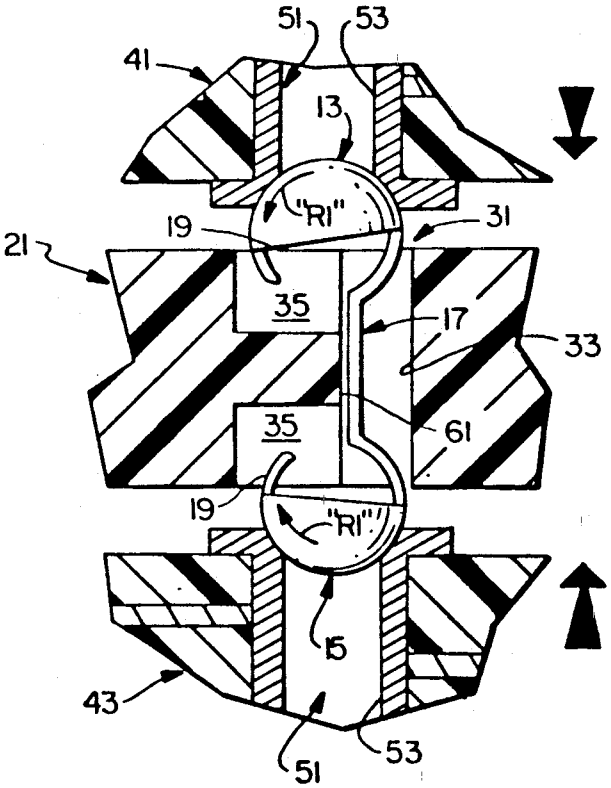
FIGS. 3-5 illustrate the various steps of engagement by the contact of the invention with two circuit members, the contact electrically interconnecting these members as a result of said engagement.
Figure 3:
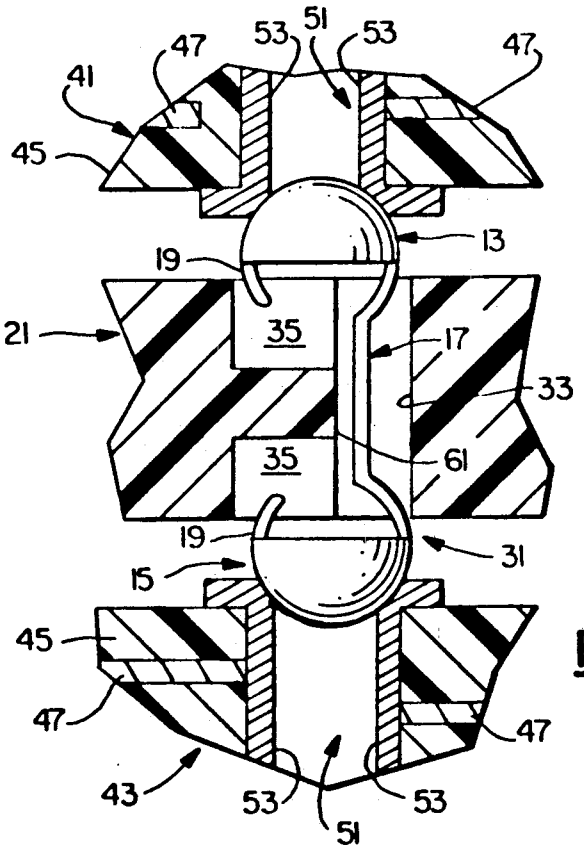
Figure 5:
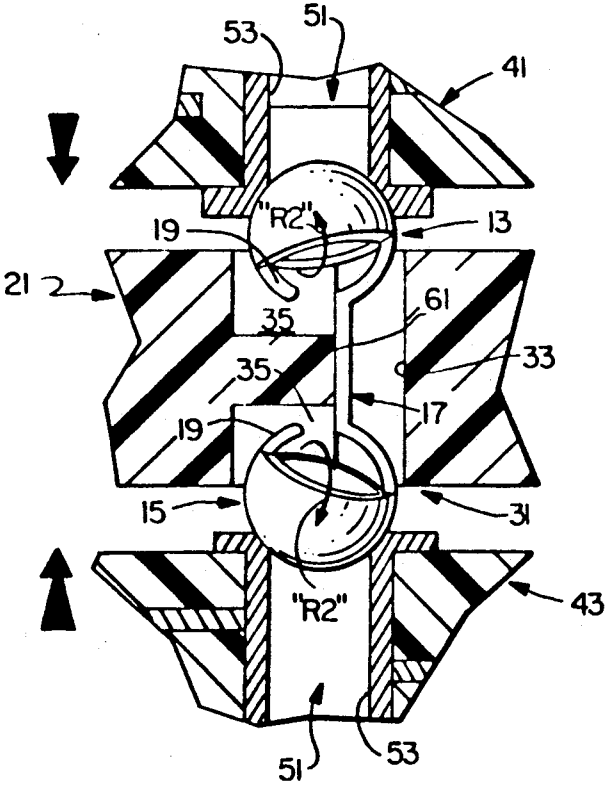

As shown in FIG. 2, contacts 10 are positioned within an insulative member 21, which member is designed for being positioned substantially between the opposing circuit members being connected (FIGS. 3-5). Insulative member 21 is preferably of plastic, with suitable examples of such material being phenolic, polyester, and Ryton (a trademark of Phillips Petroleum Company). In one embodiment of the invention, insulative member 21 preferably possesses an overall height (dimension "H" in FIG. 2) of only about 0.080 inch. Additionally, insulative member 21 is preferably formed of a plurality of individual segments 23, each designed for housing a row of several such contacts 10 therein. Each segment 23 is then joined by appropriate means (e.g., adhesive, clamping, etc.), not shown, so as to abut each other to form the configuration depicted in FIG. 2. It is understood that several such individual segments 23 may be utilized to form a connector in accordance with the teachings of the invention. Accordingly, the invention is not limited to only two such segments as depicted in FIG. 2. In one example of the invention, a total of twenty-nine such segments 23 will preferably be utilized, each accommodating a total of twenty-nine contacts therein, to thus provide an overall connector structure having a total of 841 such contacts as part thereof. In the particular embodiment as depicted in FIG. 2, it is understood that a facing member, or another segment 23, is necessary for placement against the portion of segment 23 facing the viewer, in order to positively assure retention of the individual contacts 10 within this nearest segment. Such a facing member 10 may include, simply, a relatively flat member (not shown) which abuts against the surface 25 of segment 23 facing the viewer in FIG. 2, this member held against the surface by any appropriate means (e.g., a clamp, adhesive, etc.).

Each contact 10 is located within a respective opening 31 provided within insulative member 21. Each opening 31 includes a longitudinal channel or slot 33 in which the intermediate portion 17 of each contact is positioned. This positioning relationship is also seen in FIGS. 3-5. The curved end portions 13 and 15 of each contact project from the respective upper and lower surfaces of insulative member 21, with the respective projecting tabs 19 extending in an opposing manner so as to reside substantially within the provided openings. This inward projection of tabs 19 is also considered an important aspect of the invention in order for each of the curved end portions 13 and 15 to act in the manner defined herein.

Within each opening 31 in insulative member 21 there is provided a pair of cam surfaces 35, each of which is slidably engaged by a respective tab 19 during the final stages of connection provided by connector 11. It is understood, however, that these tabs do not slidably engage cam surfaces 35 during the initial stage of connection. This movement by the curved end portions of the contacts 10 as used in the invention will be further described below with respect to FIGS. 3-5.

Figure 7:
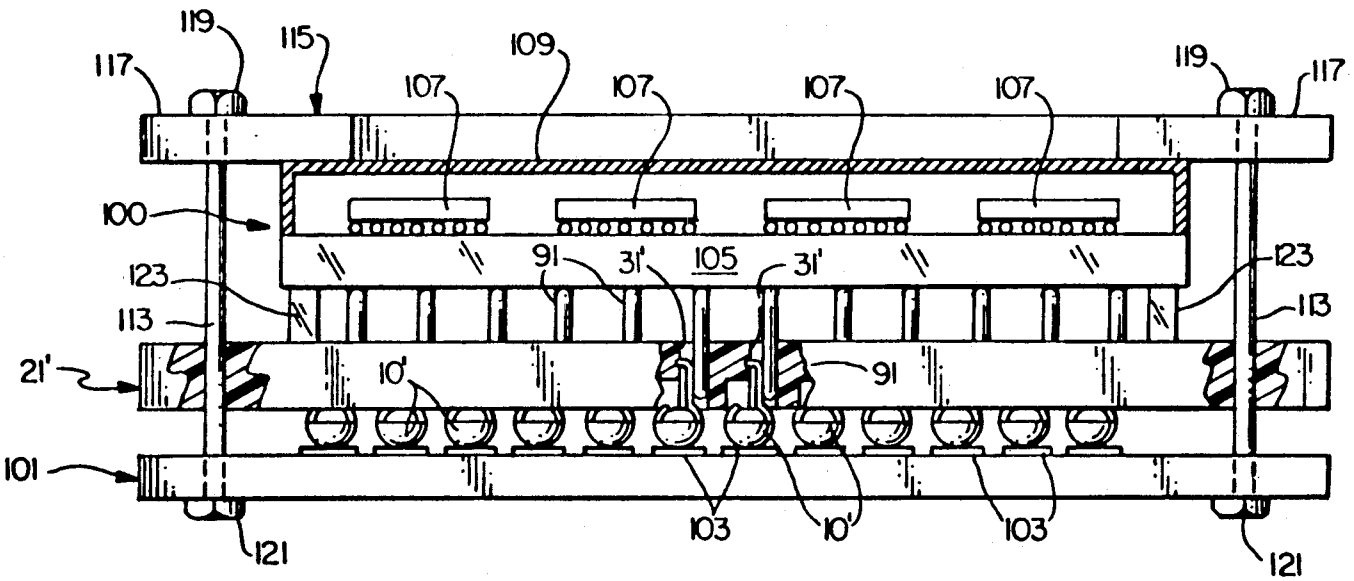
FIG. 7 is a side elevational view of a connector assembly including means for aligning and retaining various internal elements thereof (including, for example, the housings and contacts depicted in FIGS. 1-6).

In FIGS. 3-5, there are illustrated the various phases for providing electrical interconnection between two circuit members in accordance with a preferred embodiment of the invention. The two circuit members being interconnected are represented by the numerals 41 and 43 in FIGS. 3-5 and, as stated above, each comprise a circuit board. Typically, circuit boards include a dielectric material 45 with one or more conductive layers 47 therein and/or thereon. In the embodiments depicted in FIGS. 3-5, the conductive layers are located internally of the circuit board structure, each such structure preferably including several such conductive layers. Interconnecting selected ones of these layers within each circuit board is at least one (and preferably several) plated through holes 51 which, as is known in the art, preferably includes a layer of conductive metal 53 (e.g., copper) which extends from an outer surface of the circuit board's dielectric through the entire structure. In the preferred embodiments depicted in FIGS. 3-5, the end segment of each such plated through hole 51 is preferably substantially tapered. This is not meant to limit the invention, as stated above, however, because the contacts of the present invention are also capable of interconnecting other surface configurations for circuit member conductors, including other configurations of plated through holes. One particular example of another type of conductor which may be engaged by the end segment of the invention's contacts is a substantially flat conductor pad (e.g., of copper) as are also known in the art. Such pads are illustrated in the embodiment of FIG. 7. If plated through holes are utilized, each end configuration is preferably provided with a plating of sound conducting material, as was also provided on each of the described curved end portions 13 and 15 of contacts 10. In one embodiment of the invention, this preferred material was a thin layer (flash) of gold, having a thickness of only about fifty microinches.

During the initial stage of connection, as depicted in FIG. 3, the plated through holes 51 of circuit members 41 and 43 initially engage the semi-spherical end portions 13 and 15 of contact 10, respectively. Intermediate portion 17 of contact 10 is spacedly positioned from the internal walls of opening 31 during this initial engagement, while the projecting tabs 19 are also spaced from the adjacent, respective cam surfaces 35. In this arrangement, it is understood that contact 17 is self-aligning within insulative member 21. That is, the contact, by virtue of its design and positioning within member 21, is able to move, albeit slightly, in a lateral manner if necessary (e.g., to accommodate for slight misalignment of the respective plated through holes 51). Alignment of insulative member 21 relative to the adjacent, opposed circuit members 41 and 43 may be accomplished by one of several methods, including the pin-aperture arrangement defined in filed applications Ser. No. 07/628,057 and Ser. No. 07/734,419. The disclosures of these applications are incorporated herein by reference. Attention is also directed to FIG. 7 for a preferred means of aligning the invention relative to additional components (e.g., a circuit module and printed circuit board).

During additional closure of both circuit members, as illustrated in FIG. 4, the opposed semi-spherical contacting end portions 13 and 15 rotate in a first direction as shown. This first direction is also represented by the designation "R1" in FIG. 2. Comparing FIGS. 2 and 4, it is understood that this initial direction of rotation results in a slight, inward movement of each semi-spherical end portion toward the center of the individual contact 10 (and thus the insulative member 21). During such inward motion by the opposed end portions, the intermediate portion 17 moves substantially laterally toward an internal wall 61 formed within opening 31. The inward motion of end portions 13 and 15 thus enables a connector possessing several such contacts 10 therein to accommodate for "out-of-flatness" of the respective circuit members being coupled. As understood, circuit members such as printed circuit boards are preferably of substantially planar configuration but, due to tolerance accumulation during manufacture, may not be completely planar along the outer surfaces thereof. Such "out-of-flatness" may also result from these members being slightly misaligned relative to the invention. Significantly, the contacts of the invention are able to adjust for such "out-of-flatness" (or non-planarity) and yet still provide the unique interconnections taught herein.

Additional closure of circuit members 41 and 43, as depicted in FIG. 5, results in each of the semi-spherical end portions 13 and 15 rotating in a second, different direction of rotation (referred to as "R2") from original rotational movement "R1". This second rotation, substantially toward the viewer in FIG. 5, is substantially perpendicular to the original direction of rotation "R1" during the initial stages of connection (FIG. 4). This second rotation occurs as a result of the projecting tabs 19 now engaging the respective cam surfaces 35 to cause the associated end portion to now rotate in such a manner. Significantly, the described dual mode of rotation for each of the invention's curved end portions (13, 15) provides a dual wiping motion against the respective, tapered end surfaces of the plated through holes 51 being connected. This dual wiping is considered important to effectively remove contaminants or the like which form on the surfaces of the plated through holes and possibly adversely affect a desired connection therewith. As also seen in FIG. 5, this second rotational movement occurs during engagement between intermediate portion 17 of contact 10 and the described, internal wall 61.

As also seen in FIG. 2, the two cam surfaces 35 used for each contact 10 are preferably substantially planar and, as shown, oriented at an acute angle with respect to each other. This is not meant to limit the invention, however, in that other surface configurations and angular relationships are possible. For example, it is also possible to utilize cam surfaces of substantially curvilinear configuration.

Figure 6:
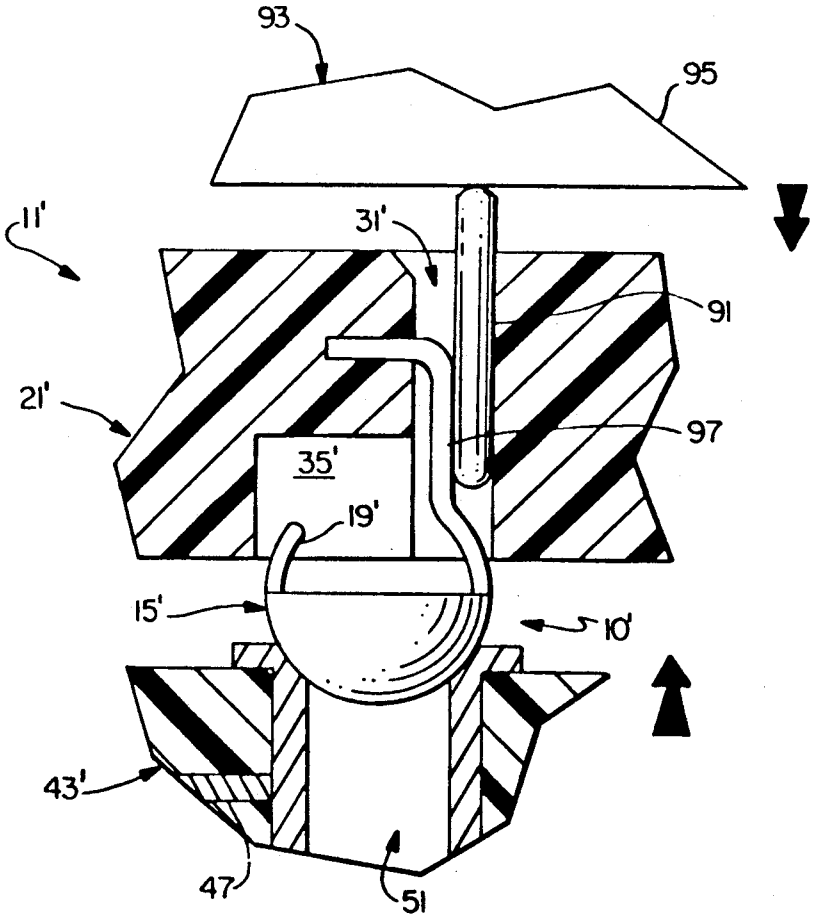
FIG. 6 is a side, elevational view, in section, of a connector in accordance with an alternate embodiment of the invention.

In FIG. 6, there is shown a connector 11' in accordance with another embodiment of the invention. Connector 11', similar to connector 11, includes an insulative housing 21' with an opening 31' therein designed to accommodate a respective contact 10'. Contact 10' includes one semi-spherical, curved end portion 15', substantially similar in configuration to the aforedefined curved end portions for contact 10. As such, end portion 15' includes a projecting tab 19', which tab is designed for engaging, slidably, a cam surface 35' formed within housing 21'. It is understood that in a preferred embodiment of the invention, connector 11' includes several openings 31' and associated contacts 10' therein, and the invention is thus not limited to the singular embodiment depicted in FIG. 6.

Connector 11', unlike connector 11, however, is specifically designed for having a male pin (91) or the like inserted within an opposing end of opening 31' from the location of curved end 15'. Pin 91, as known, may form part of a circuit module 93, several types of which are known in the art (see also FIG. 7). For example, such modules may include a ceramic member 95 with a plurality of such pins, typically copper, projecting from a surface thereof. It is thus understood that connector 11 is specifically designed for providing electrical connection between such a module and another circuit member, e.g., a circuit board, such as represented by the numeral 43'. Such a circuit board, as shown in FIG. 6, may include the tapered plated through hole 51 and internal conductive layers 47 (one shown in FIG. 6), as did the circuit members 41 and 43 described above. Further description of these circuit members is thus not believed necessary.

To satisfactorily engage pin 91, contact 10' includes a projecting leg 97 which extends from curved end portion 15' into opening 31', where it is preferably secured within an internal wall of insulative member 21', as shown. Such retention may be accomplished using techniques known in the art, and further description is not believed necessary. Leg portion 97 is positioned within opening 31' so as to slidably engage pin 91 during insertion thereof within opening 31' and to become slightly depressed (moved laterally to the left in FIG. 6) during such engagement. Understandably, this engagement is frictional in nature and provides a desired wiping motion between leg portion 97 and pin 91.

The connector in FIG. 6 is thus able to provide a dual rotational motion by one contacting end portion thereof with a respective circuit member to provide the significant advantages described herein. Additionally, the connector of FIG. 6 is also able to provide effective, sliding (wiping) engagement with a male pin member or the like when this member is inserted within the connector's insulation member 21'.

In one embodiment of the invention, contact 10' is preferably comprised of the same material as contact 10 in FIG. 1, and formed from a singular strip of such material using procedures (e.g., stamping, etc.) known in the art.

In FIG. 7, there is illustrated an assembly adapted for containing the various embodiments of the invention as defined above therein. That is, this assembly may include either of the connectors 11 or 11' therein, to provide effective electrical connection between a pair of electrical circuit members also contained therein. In FIG. 7, the preferred circuit members include a module 100 (as mentioned above) and a circuit board 101. Board 101 may include plated through holes of the type defined above (including those with tapered conductors as illustrated in FIGS. 3-5) or, alternatively, may include flat pad conductors 103 such as shown in FIG. 7. Module 100 preferably includes a ceramic substrate member 105 (which may be similar to member 95 in FIG. 6) having a plurality of pins 91 projecting therefrom. Module 100, as mentioned earlier, preferably includes a plurality of semiconductor chips 107 electrically connected to circuitry (not shown) located on an opposite surface of member 95 from pins 91. Covering chips 107, and possibly offering heat sinking capabilities (if necessary) is a metallic cover 109 which, as shown, is secured to/about substrate member 105. Understandably, cover 109, member 105, chips 107 and pins 91 thus comprise module 100.

The assembly of FIG. 7 includes a pair of aligning rods 113 spacedly positioned on (and extending through) circuit board 101, which rods each also pass through electrically insulative member 21'. Member 21', as defined in FIG. 6, includes several contacts 10' spacedly located therein (each contact 10' being within a provided opening 31', as in FIG. 6). Each contact 10' is in turn adapted for physically engaging (and being electrically connected to) a respective conductor pad 103 when module 100 is located in engagement (through pins 91) with member 21', and, particularly, the contacts 10' therein. Contacts 10' also slidably engage pins 91 during such module insertion within member 21'. Accordingly, member 21' is properly aligned, using rods 113, relative to circuit board 101 such that each contact 10' will be precisely aligned relative to a respective pad 103 so as to engage same (as shown in FIG. 7). In one example of the invention, each pad is preferably of rectangular shape (in plan view, taken from above) with side dimensions of about 0.020 inch and 0.030 inch, respectively. Each pad also includes a thickness of about 0.002 inch, these being arranged in a pattern with center-to-center distances therebetween of only about 0.050 inch. Understandably, this close, highly dense pattern of pads and associated contacts (the latter also obviously spaced at similar center-to-center spacings) mandates precise alignment therebetween. The assembly of FIG. 7 is able to provide this alignment.

To contain the assembly in the compressed arrangement depicted in FIG. 7, the assembly further includes at least one engagement member 115 having outer side portions 117 for physically engaging the upper surface of cover 109 and thus hold module 100 in position within (and against) member 21'. Engagement member 115 can exert additional force against cover 109 by tightening of retention nuts 119 located on threaded ends (not shown) of rods 113. Similar retention nuts or, alternatively, rods with appropriate head portions, (e.g., 121) can be used to act against the back (bottom) surface of board 101. Engagement member 115 need only exert sufficient force against module 100 to overcome the combined frictional forces between pins 91 and contacts 10' and thereby achieve insertion of pins 91 to the depths illustrated within member 21'. Stops 123 may be utilized to limit this depth of pin insertion to a prescribed distance. Such stops may be located atop the upper surface of member 21' or be located on and extend below the bottom surface of substrate 105.

Understandably, rods 113 also provide alignment between engagement member 115, member 21' and board 101. If needed, member 115 could also be provided with additional features (for example, projecting flanges or internal indentations) to mate with the outer surfaces of cover 109 and thus align module 100 relative to (e.g., partially within) member 115.

There has thus been shown and described an electrical connector which provides effective connection between two spaced-apart circuit members in a sound and effective manner. The invention as defined accomplishes this connection using wiping motion and thus benefits from the several advantages associated therewith. More enhanced connection is made possible by the provision of a sound conducting material (e.g., gold) on respective contacting surfaces of the invention's contact members. The invention is, uniquely, self-aligning to accommodate for possible misalignment of various components being joined, in addition to being readily separable should such separation be desired (e.g., for repair and/or replacement). Further, the invention as defined is of relatively simple configuration and is able to be operated in a relatively simple manner.

While there have been shown and described what are at present considered the preferred embodiments of the invention, it will be obvious to those skilled in the art that various changes and modifications may be made therein without departing from the scope of the invention as defined by the appended claims.

What is claimed is:

1. A connector for electrically interconnecting first and second electrical circuit members, said connector comprising:

an electrically insulative member adapted for being positioned substantially between said first and second electrical circuit members; and at least one electrically conductive, resilient contact positioned within said insulative member for electrically interconnecting said first and second electrical circuit members, said contact including at least one curved end portion for engaging one of said circuit members, said curved end portion being movable in a first direction of rotation during initial engagement with said electrical circuit member and thereafter movable in a second, different direction of rotation during subsequent engagement with said electrical circuit member.

2. The connector according to claim 1 wherein said electrically insulative member includes at least one opening therein, said contact being positioned within said opening and extending therefrom.

3. The connector according to claim 2 wherein said electrically insulative member includes a cam surface, said curved end portion of said contact engaging said cam surface during said subsequent engagement of said curved end portion with said electrical circuit member to cause said curved end portion to move in said second, different direction of rotation.

4. The connector according to claim 3 wherein said contact includes a leg portion extending within said opening and secured to said electrically insulative member, said leg portion adapted for engaging one of said circuit members when said circuit member is positioned within said opening.

5. The connector according to claim 3 wherein said curved end portion of said contact includes a projecting tab, said projecting tab slidably engaging said cam surface during said subsequent engagement of said curved end portion with said electrical circuit member.

6. The connector according to claim 5 wherein said curved end portion is of substantially semi-spherical configuration, said tab projecting therefrom.

7. The connector according to claim 1 wherein said contact further includes a second curved end portion for engaging the other of said electrical circuit members, said curved end portions being joined by an intermediate portion.

8. The connector according to claim 7 wherein said electrically insulative housing includes at least one opening therein, said intermediate portion of said contact being positioned substantially within said opening, said curved end portions of said contact extending from said opening.

9. The connector according to claim 8 wherein said electrically insulative housing includes an internal wall, said intermediate portion of said contact engaging said wall during said engagement of said curved end portions with said electrical circuit members.

10. The connector according to claim 1 further including means for aligning said electrically insulative member relative to said electrical circuit member engaging said curved end portion of said contact.

11. The connector according to claim 10 wherein said means for aligning comprises a pair of aligning rods, each of said aligning rods being located substantially within said electrical circuit member engaging said curved end portion of said contact and extending through said electrically insulative member.

12. The connector according to claim 1 further including means for exerting force against one of said circuit members in a direction toward said electrically insulative housing and the other of said circuit members to hold said circuit members and said electrically insulative housing in a substantially fixed orientation relative to each other.

13. The connector according to claim 12 wherein said means for exerting said force comprises an engagement member for engaging a surface of said circuit member to exert said force thereagainst, said engagement member being positioned in alignment with the other of said circuit members.

14. The connector according to claim 13 further including a pair of aligning rods for providing said alignment between said engagement member and the other of said circuit members, each of said aligning rods passing through said engagement member and said other of said circuit members.

15. The connector according to claim 14 wherein said aligning rods further pass through said electrically insulative member having said electrically conductive contact therein to thereby align said electrically insulative member relative to said engagement member and said other of said circuit members.

* * * * *